US007572085B2

(12) United States Patent
Luppi

(10) Patent No.: US 7,572,085 B2
(45) Date of Patent: Aug. 11, 2009

(54) DEVICE FOR UPPER CONNECTION BETWEEN TWO SUBMARINE FLUID TRANSPORTING PIPELINES

(75) Inventor: Ange Luppi, Nîmes (FR)

(73) Assignee: Technip France (FR)

( * ) Notice: Subject to any disclaimer, the term of this patent is extended or adjusted under 35 U.S.C. 154(b) by 50 days.

(21) Appl. No.: 11/576,655

(22) PCT Filed: Oct. 4, 2005

(86) PCT No.: PCT/FR2005/002433

§ 371 (c)(1),
(2), (4) Date: Apr. 4, 2007

(87) PCT Pub. No.: WO2006/037886

PCT Pub. Date: Apr. 13, 2006

(65) Prior Publication Data

US 2008/0056826 A1 Mar. 6, 2008

(30) Foreign Application Priority Data

Oct. 5, 2004 (FR) ..... 04 10492

(51) Int. Cl.
*F16L 1/00* (2006.01)

(52) U.S. Cl. ..... 405/158; 441/5

(58) Field of Classification Search ..... 405/154.1–171, 405/195.1, 202, 224.2–224.4; 441/4, 5; 166/343, 166/345, 350, 351, 352, 353, 354, 355, 397
See application file for complete search history.

(56) References Cited

U.S. PATENT DOCUMENTS 4,367,055 A * 1/1983 Gentry et al. ..... 405/169
4,388,022 A 6/1983 Gentry et al. ..... 405/195
4,396,046 A * 8/1983 Kentosh ..... 441/5
4,423,984 A 1/1984 Panicker et al.
4,848,949 A * 7/1989 Castel ..... 403/12
5,205,768 A 4/1993 Pollack ..... 441/5
5,615,977 A 4/1997 Moses et al. ..... 405/195.1

(Continued)

FOREIGN PATENT DOCUMENTS

EP 0 459 649 A 12/1991

(Continued)

OTHER PUBLICATIONS

International Search Report PCT/FR2005/002433 dated Jan. 5, 2006.

*Primary Examiner*—David J Bagnell
*Assistant Examiner*—Benjamin Fiorello
(74) *Attorney, Agent, or Firm*—Ostrolenk, Faber, Gerb & Soffen, LLP

(57) ABSTRACT

The invention concerns a device for upper connection connecting two terminal endpieces (9, 10) of two submarine fluid transporting pipelines (2, 4) used in offshore hydrocarbon exploitation, a riser supported by at least one buoyant element (6) and a second pipe connecting the riser to a production and/or storage installation located at the surface, the device comprising an intermediate linking pipe (8) mounted mobile relative to the terminal endpieces of the riser and the second pipe between an operational position wherein it is connected at its two ends to said endpieces of the riser (2) and the second pipe (4) and an intervening position wherein its ends are disconnected from said endpieces (9, 10).

6 Claims, 2 Drawing Sheets

U.S. PATENT DOCUMENTS

| | | | | |
|---|---|---|---|---|
| 5,639,187 | A | 6/1997 | Mungall et al. | 405/195.1 |
| 5,651,709 | A * | 7/1997 | Nandakumar et al. | 441/5 |
| 6,685,397 | B1 | 2/2004 | Dixon-Roche | 405/224.2 |
| 2004/0161984 | A1 | 8/2004 | Lima de Almeida et al. | 441/4 |

FOREIGN PATENT DOCUMENTS

| | | |
|---|---|---|
| FR | 2 809 136 | 11/2001 |
| WO | WO 02/103153 | 6/2002 |

* cited by examiner

DEVICE FOR UPPER CONNECTION BETWEEN TWO SUBMARINE FLUID TRANSPORTING PIPELINES

CROSS REFERENCE TO RELATED APPLICATION

The present application is a 35 U.S.C. §§ 371 national phase conversion of PCT/FR2005/002433, filed Apr. 13, 2006, which claims priority of French Application No. 0410492, filed Oct. 5, 2004. The PCT International Application was published in the French language.

BACKGROUND OF THE INVENTION

The present invention concerns the field of pipelines, used in production offshore or at sea, for the conveyance of fluids and, in particular, hydrocarbons. More specifically, it concerns the connecting device between a riser linking a subsea installation located on the seabed to an intermediate surface or subsurface installation such as a buoy and a jumper designed to link the top end of said riser to a production and/or storage facility located at the surface. It also concerns the configuration of the associated riser comprising all the lines and connecting devices linking the subsea installation (wellhead manifold for example) to the surface production facility.

Many riser configurations designed to link a subsea installation to a surface facility are known in the prior art. For example, we can cite not only configurations of catenary risers, the latter comprising either flexible or rigid lines, but also configurations featuring vertical risers. In these latter cases, the configuration is usually in form of a flow-line pipe linked to a vertical riser by a bottom connecting device (such as the one illustrated in patent WO 02/103153). The top end of the riser is connected to a second line, most often flexible and generally shorter, called a "jumper". This line extends the riser to allow the conveyed fluid to flow towards a production and/or storage facility usually at the surface. The bottom end of the vertical riser is anchored at the bottom connecting device and is usually supported at its top end by one or more buoys, which support the weight of said line. In some cases, buoyancy units are also arranged along the riser. At its top end, the riser is connected to the jumper by a top connecting device, which can be of several forms.

In the prior art, top connecting devices are therefore known in which the riser is suspended below the buoy, the device being in the form of a gooseneck, said gooseneck being connected to both lines (riser and jumper) by flange-type connections with or without swivel joints. In this case, the buoy is connected to said device by a retaining element located between its bottom end and a support structure, which maintains and retains the ends of the two lines and the connection gooseneck. This type of connection is moreover described in patent FR 2 809 136 in combination with a catenary riser or in patent WO 02/103153 in combination with a vertical riser.

Another connecting device of the prior art involves making the connection at the top end of the buoy. Such a device is, in particular, described in U.S. Pat. No. 4,423,984, which shows a multiplicity of vertical risers surrounded by two buoys and connected to as many jumpers at the top end of the buoy.

However, these top connecting devices of the prior art do not give total satisfaction with regard to the many problems with which these devices are liable to be confronted. Some devices effectively involve long, costly installation procedures and do not, or only with difficulty, allow maintenance interventions of either standard or exceptional nature. For example, the top connecting device must effectively allow a smaller secondary line to be introduced into the riser for maintenance operations on subsea installations (so called "coiled tubing" operations) or introduction of tooling such as inspection "pigs". In patent FR 2 809 136, this is performed using an element forming a secondary line as a retaining element between the buoy and the riser. In another case, "coiled tubing" is directly performed at the connecting device such as, for example, at the gooseneck, which features a section of bypass line providing direct secondary access to the riser.

Furthermore, the top connecting device must also allow replacement of the jumper, if need be, without requiring an excessively long production stoppage. Similarly, connection of the connecting device to the two lines must be simple and not complicate installation of the riser and the associated buoy.

SUMMARY OF THE INVENTION

Thus, the object of the present invention is to overcome the drawbacks of the prior art referred to above. It therefore proposes a top connecting device between a riser supported by a buoy and a jumper linking the riser to a production and/or storage facility located at the surface, which allows simple installation and both maintenance and rapid intervention possibilities.

According to the invention, the top connecting device is designed to connect the end fittings of two subsea fluid conveyance lines, used in offshore hydrocarbon production, to ensure continuity, a first line known as a riser supported by at least one buoyancy unit and a jumper linking the riser to a production and/or storage facility located at the surface; it is characterized in that it comprises an intermediate connecting pipe mounted to move with respect to the end fittings of the riser and the jumper, said intermediate pipe being able to move between an operating position, wherein it is connected at its two ends to said end fittings of the riser and the jumper and an intervention position, wherein its ends are separated from said end fittings.

According to an additional feature, the intermediate connecting pipe is mounted to pivot on the buoyancy unit.

The invention also concerns a riser configuration, in which the link between the riser and a jumper connected to a surface installation is ensured by a connecting device conforming to the invention, said configuration features a buoyancy unit supporting the riser comprising a buoy crossed, that is, passed through by, said riser along its axis of revolution, the end fitting of said riser emerging from the top face of said buoy.

According to an additional feature, the riser configuration is characterized in that the buoy has a fixing element, into which the end fitting of the jumper is suitable for fixing, to make fast the end of the jumper to the buoy.

BRIEF DESCRIPTION OF THE DRAWINGS

Other particular characteristics and advantages of the invention will emerge from reading the description given below of a particular embodiment of the invention, provided for information only but without limitation, in reference to the appended drawings in which.

DESCRIPTION OF A PREFERRED EMBODIMENT

Figure 1:
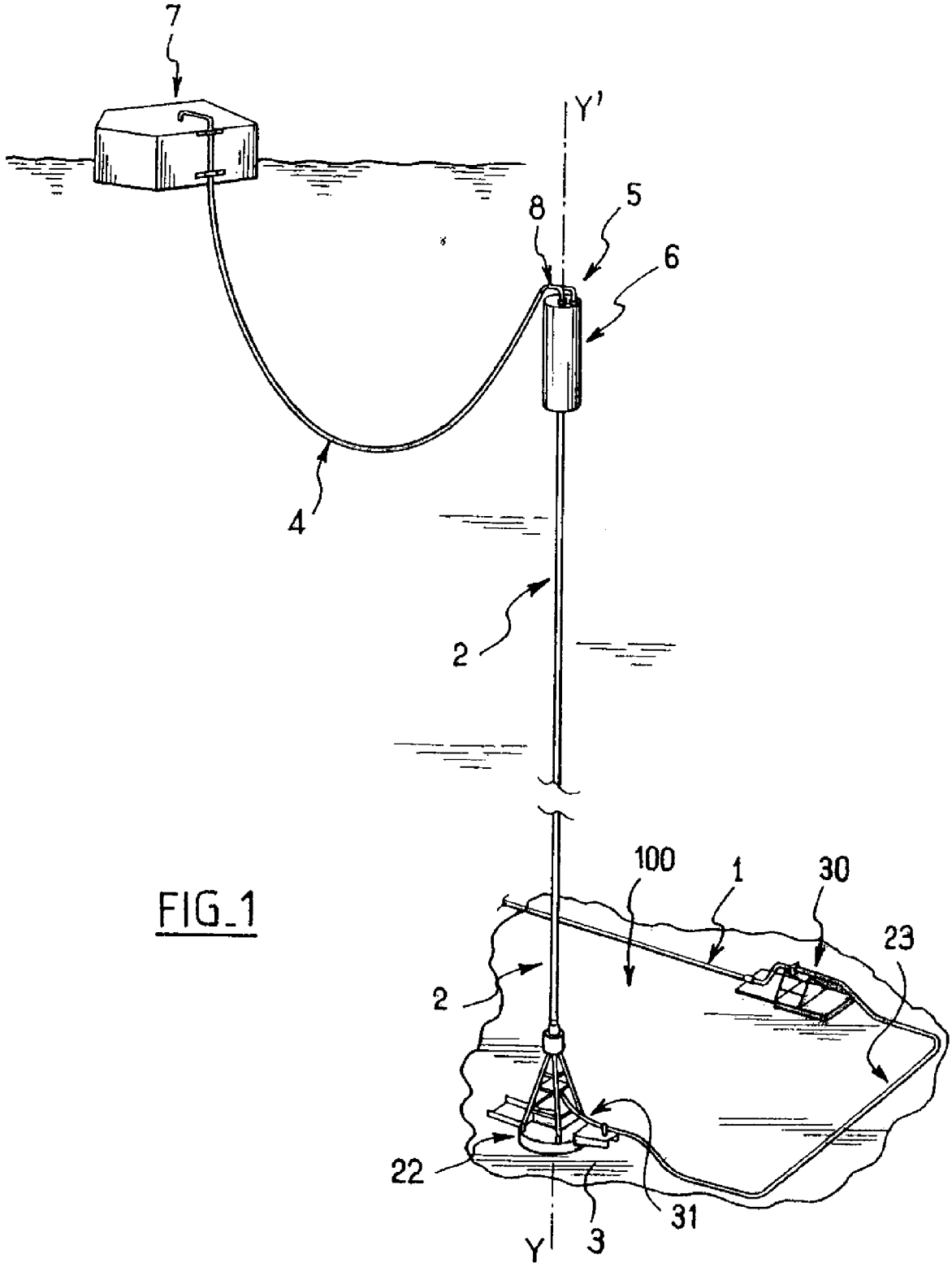
FIG. 1 is a perspective diagrammatic view of a riser configuration using the top connecting device of the invention.

FIG. 1 represents a riser configuration according to the invention. It comprises a flow-line pipe 1 connected to a vertical-type riser 2 though a bottom connecting device 3. Said device ensures anchorage on the seabed of the vertical riser 2. The riser 2 is supported at its top end by a buoy-type buoyancy unit 6, which supports the weight and positions said riser. A top connecting device 5 connects the riser 2 at its top end to a jumper 4 designed to allow transfer of fluids from the riser to a surface facility 7 intended for production and/or storage of hydrocarbons, such as a platform or a flotation, production, storage and offloading (FPSO) vessel, for example. This jumper 4 is advantageously a flexible-type line commonly called a jumper. This configuration in particular allows the riser to be protected from forces likely to be created by movements of the surface facility, which are thus absorbed mainly by the jumper 4.

The top connecting device 5 comprises an advantageously rigid intermediate connecting pipe in the form of an elbow 8 fitted with connecting elements at each of its ends, allowing it to be connected to the end fittings 9, 10 of the lines to be linked, the riser 2 and the jumper 4 respectively. The connecting elements, not shown, can be of any type and are well known to a person skilled in the art; they are advantageously connecting elements, which require no diver intervention to finalize the connection operation.

Figure 2:
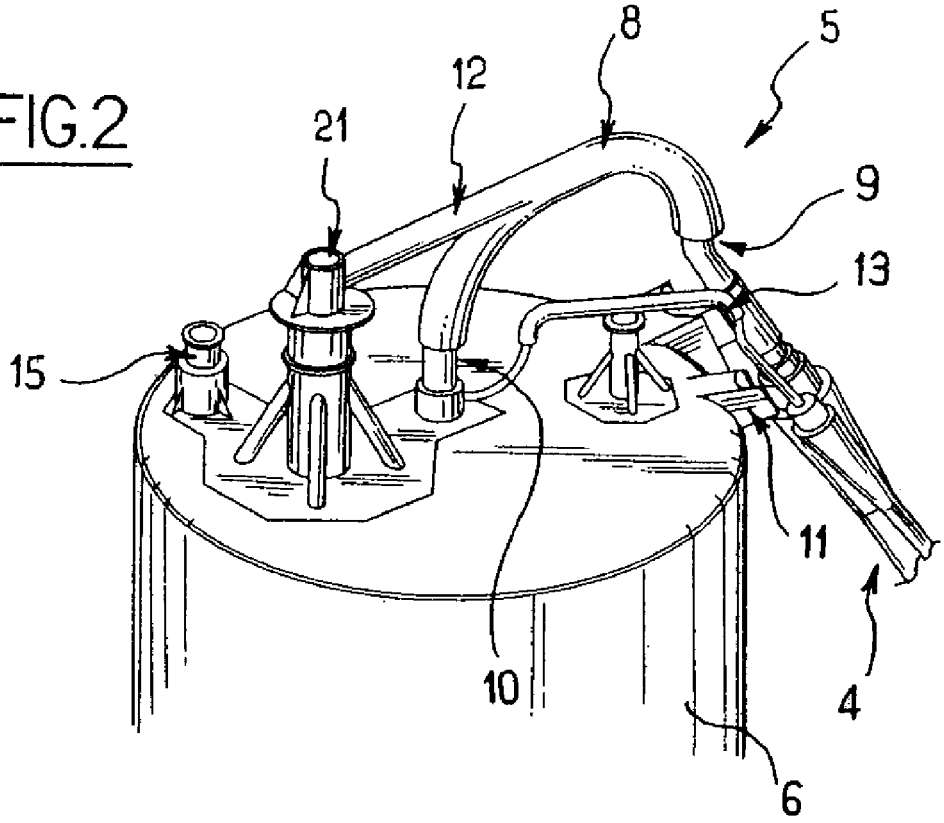
FIG. 2 is a perspective partial diagrammatic view of the top connecting device in an operating position.
Figure 3:
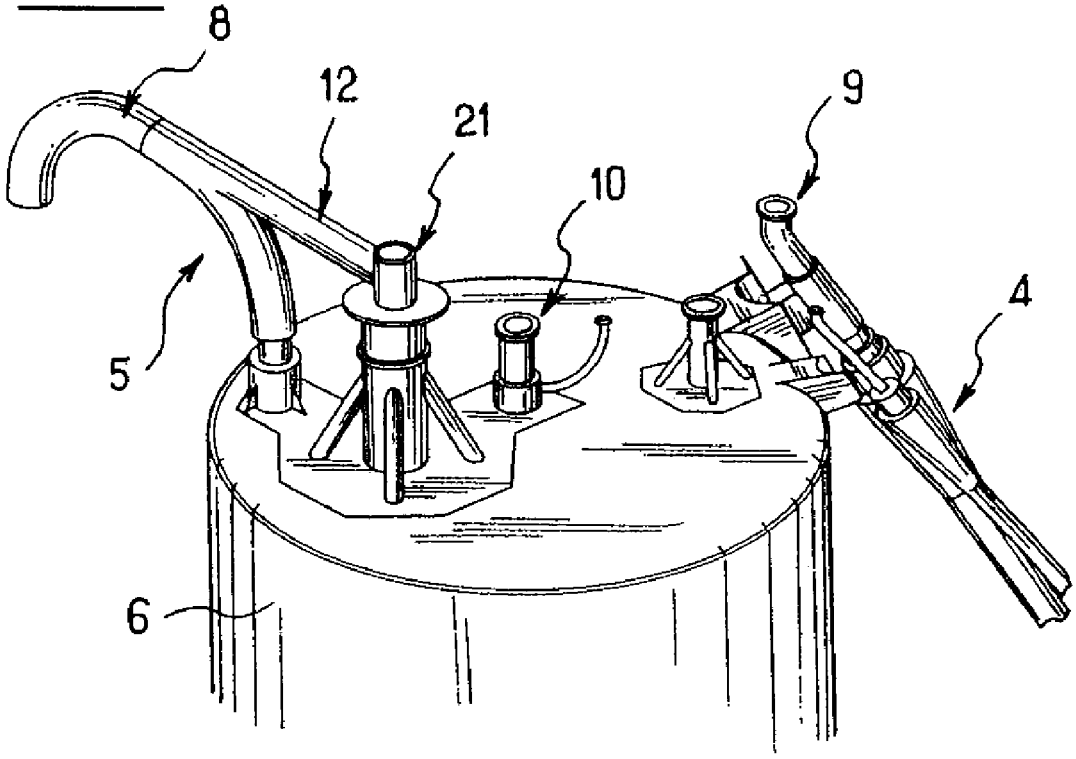
FIG. 3 is a perspective partial diagrammatic view of the top connecting device in an intervention position.

This intermediate connecting pipe 8 is mounted to move, with respect to the lines to be connected 2, 4, between a so-called operating position and a so-called intervention position illustrated in FIGS. 2 and 3 respectively. In the operating position, it is connected at its two ends to the riser 2 and the jumper 4 whilst, in the intervention position, it is detached from the end fittings 9, 10 of the lines 2, 4, leaving free access to these lines. It is thereby possible to gain access directly to the riser 2 through its end fitting 10, which is advantageously located on the top part of the buoy 6. Similarly, the end fitting 9 of the jumper 4 is accessible.

According to the illustrated embodiment of the invention, the riser 2 is supported by a buoy 6, which it crosses that is, passes through the buoy along its YY' axis of revolution such that its end fitting 10 emerges from the top face of said buoy. The buoy also has a recess or fixing element 11, into which the end fitting 9 of the jumper 4 is suitable for fixing, to make fast the end of the jumper to the buoy. It may also be noted that, in the intervention position, the end fitting 9 can be easily be detached from the element 11 without inconvenience caused by the different elements of the top connecting device 5. Similarly, access to the end fitting 10 of the riser 2 for so-called "coiled tubing" operations for example, is gained directly along the axis of said riser through said end fitting 10.

The intermediate pipe 8 is advantageously mounted to pivot on the buoy 6 between an operating position and an intervention position. Pivoting is controlled by an underwater intervention vehicle, know under the acronyms ROV or AUV (Remote Operated Vehicle or Autonomous Underwater Vehicle), said vehicle being capable of releasing a locking mechanism, not shown, and of controlling and monitoring the pivoting movement by acting on the pivoting axis 11 of the intermediate connecting pipe 8. According to the illustrated embodiment of the connecting device, the intermediate pipe 8 is connected to its pivoting axis 21 by an arm 12, thereby allowing the pivoting mechanism to be located at a distance from the end fittings 9 and 10. It may be noted that locking of the intermediate connecting pipe 8 can be ensured by a low position illustrated in FIG. 2, in which it is locked in rotation, and a high position, in which rotation can be controlled by the underwater robot to bring it into its intervention position illustrated in FIG. 3. In the intervention position, one of the ends of the connecting pipe positions itself advantageously on a projecting element 15, allowing its intervention position to be locked to ensure free access to the end fittings 9, 10 during maintenance or other operations performed by the operator.

In some cases, the configuration illustrated in FIG. 1, can also comprise so-called secondary lines such as gas lift lines. These lines can be connected to the riser and jumper 2, 4. Thus, a connecting device 13 can be provided for these secondary lines as illustrated in FIG. 2. However, this connection does not necessarily have the pivoting mobility of the top connecting device 5.

The riser configuration of the invention comprises a bottom connecting device 3, which links the end of the flow-line pipe 1 to the riser 2. This device comprises, for example, a base 22 anchored to the seabed, which keeps the bottom end of the riser 2 linked to a connection line 23 of type known in itself, also called a "spool piece". This spool piece is laid horizontally static on the seabed 100, it is designed in particular to take up variation in length of the flow-line pipe 1, to which it is connected by a connection 30. This spool piece 23 is also connected at its second end to a gooseneck 31, fixed to the base 22 to ensure continuity with the riser 2.

It goes without saying that while the invention applies advantageously to so-called vertical risers, it would not go beyond the field of application of the present invention by using a similar top connecting device for catenary risers.

The invention claimed is:

1. A combination operable for connecting respective end fittings of two subsea fluid conveyance lines, comprising:

a buoyancy unit;

one line is a riser supported by the one buoyancy unit, the riser having a first end fitting located at the buoyancy unit, the other line is a jumper operable for linking the riser to a production or storage facility, the jumper having a second end fitting located at the buoyancy unit, an intermediate connecting pipe having first and second connectors and being mounted on the buoyancy unit to pivot, with respect to the end fittings of the riser and the jumper between an operating position, wherein the first and second connectors of the connecting pipe are connected respectively to the first and second end fittings of the riser and the jumper, and an intervention position, wherein the connectors of the connecting pipe are separated from the respective end fittings.

2. The combination as claimed in claim 1, wherein the buoyancy unit comprises a buoy and the riser crosses and passes through the buoy along a YY' axis of revolution of the buoy, and the first end fitting of the riser emerges from a top face of the buoy.

3. The combination as claimed in claim 2, further comprising a fixing element on the buoy into which the second end fitting of the jumper is suitable for fixing, for making fast the second end fitting of the jumper to the buoy.

4. The combination as claimed in claim 1, wherein the buoyancy unit comprises a buoy and the riser crosses and passes through the buoy along a YY' axis of revolution of the buoy, and the first end fitting of the riser emerges from a top face of said buoy.

5. The combination as claimed in claim 4, further comprising a fixing element on the buoy, into which the second end fitting of the jumper is suitable for fixing, for making fast the second end fitting of the jumper to the buoy.

6. The combination as claimed in claim 1, wherein the connecting pipe has opposite ends and the connectors thereof are at respective opposite ends of the connecting pipe.

* * * * *